US006523201B1

(12) United States Patent
De Michele

(10) Patent No.: US 6,523,201 B1
(45) Date of Patent: Feb. 25, 2003

(54) SLEEP SUPPORT SYSTEM

(76) Inventor: Eliza A. De Michele, 16851 NE. 23rd Ave., Apartment 105, N. Miami Beach, FL (US) 33160

( * ) Notice: Subject to any disclaimer, the term of this patent is extended or adjusted under 35 U.S.C. 154(b) by 0 days.

(21) Appl. No.: 09/305,214

(22) Filed: May 4, 1999

(51) Int. Cl.[7] ..... A47C 16/02

(52) U.S. Cl. ..... 5/648; 5/650; 128/845; 128/882

(58) Field of Search ..... 5/630, 650, 648; 128/845, 846, 882, 889, 892; 602/5, 23, 26

(56) References Cited

U.S. PATENT DOCUMENTS

| | | | | | |
|---|---|---|---|---|---|
| 1,690,405 | A | | 11/1928 | Rocher | |
| 3,345,656 | A | * | 10/1967 | Steinman | 5/650 |
| 3,511,233 | A | * | 5/1970 | Holy, Jr. | 5/650 X |
| 3,843,979 | A | * | 10/1974 | Treace | 5/648 |
| 4,071,031 | A | * | 1/1978 | Lowman | 607/114 |
| 4,076,022 | A | * | 2/1978 | Walker | 128/892 |
| 4,136,858 | A | * | 1/1979 | Petersen | 5/648 |
| 4,320,749 | A | * | 3/1982 | Highley | 5/650 X |
| 4,375,809 | A | * | 3/1983 | Meals | 128/845 X |
| 4,615,516 | A | * | 10/1986 | Stulberg et al. | 5/650 |
| 4,736,477 | A | | 4/1988 | Moore | 5/443 |
| 4,805,605 | A | * | 2/1989 | Glassman | 602/24 |
| 4,862,535 | A | * | 9/1989 | Roberts | 5/655 |
| 4,889,109 | A | * | 12/1989 | Gifford | 606/237 |
| 4,910,818 | A | | 3/1990 | Grabill et al. | 5/443 |
| 4,981,132 | A | * | 1/1991 | Chong | 602/23 |
| 5,020,523 | A | * | 6/1991 | Bodine | 128/882 X |
| 5,046,487 | A | * | 9/1991 | Scott | 5/650 X |
| 5,048,542 | A | | 9/1991 | Murray | 128/889 |
| 5,125,123 | A | | 6/1992 | Engle | 5/648 |
| 5,134,739 | A | * | 8/1992 | Gaffe et al. | 5/648 |
| 5,151,081 | A | * | 9/1992 | Williams | 602/23 X |
| D342,856 | S | | 1/1994 | Hagen | D6/601 |
| 5,282,483 | A | * | 2/1994 | Wang | 602/23 X |
| D345,668 | S | | 4/1994 | Braly | D6/601 |
| D348,175 | S | * | 6/1994 | Kilbey | D6/601 |
| 5,370,133 | A | * | 12/1994 | Darby et al. | 602/23 X |
| 5,418,991 | A | | 5/1995 | Shiflett | 5/650 |
| 5,465,736 | A | | 11/1995 | Lonardo | 128/892 |
| 5,477,866 | A | * | 12/1995 | Davenport | 5/648 |
| 5,573,014 | A | | 11/1996 | Ginter | 128/845 |
| 5,577,998 | A | * | 11/1996 | Johnson, Jr. et al. | 602/5 |
| 5,593,383 | A | * | 1/1997 | DeToro | 602/23 X |
| 5,603,336 | A | * | 2/1997 | Shepich | 128/882 |
| 5,603,692 | A | * | 2/1997 | Maxwell | 5/650 X |
| 5,665,059 | A | * | 9/1997 | Klearman et al. | 128/882 X |
| 5,716,334 | A | * | 2/1998 | Wade | 128/882 X |
| 5,827,210 | A | * | 10/1998 | Antar et al. | 602/23 |
| 5,871,457 | A | * | 2/1999 | Swedberg et al. | 602/24 |
| 5,878,453 | A | * | 3/1999 | Stokes | 5/648 |
| 5,941,263 | A | * | 8/1999 | Bierman | 602/26 X |
| D413,981 | S | * | 9/1999 | Swedberg et al. | D24/190 |
| 5,957,872 | A | * | 9/1999 | Flick | 128/882 X |

(List continued on next page.)

*Primary Examiner*—Robert G. Santos
(74) *Attorney, Agent, or Firm*—Foley & Lardner

(57) ABSTRACT

The sleep support 10 of the present invention is a pillow-like device that includes a first rest plane 11, and second rest plane 13, such that the first rest plane 11 and the second rest plane 13 intersect. Associated with the first rest plane 11 is a thickness $t_1$ and associated with the second rest plane 13 is a thickness $t_2$, such that $t_1$ and $t_2$ are different. The sleep support 10 further defines a long axis 17 and a short axis 18. The long axis 17 is approximately parallel to the second rest plane 13 and the short axis 18 is approximately parallel to the first rest plane 11. The short axis 18 thus defines the orientation of the first rest plane 11 and the long axis 17 thus defines the orientation of the second rest plane 13. The long axis 17 forms an internal angle Θ that, preferably, is nominally a right angle with the short axis 18, where the long axis 17 and the short axis 18 intersect. Thus, the sleep support 10 is generally "L-shaped".

32 Claims, 3 Drawing Sheets

U.S. PATENT DOCUMENTS 5,957,874 A * 9/1999 Klein ..... 602/23
5,961,477 A * 10/1999 Turtzo ..... 602/23 X
5,997,491 A * 12/1999 Harris ..... 128/882 X
6,021,780 A * 2/2000 Darby ..... 128/882
6,058,534 A * 5/2000 Navarro et al. ..... 5/648
6,090,059 A * 7/2000 Wasserman et al. ..... 602/23 X
6,149,613 A * 11/2000 Klein ..... 5/650 X
6,263,531 B1 * 7/2001 Navarro et al. ..... 5/648
6,361,514 B1 * 3/2002 Brown et al. ..... 602/23

* cited by examiner

SLEEP SUPPORT SYSTEM

FIELD OF THE INVENTION

This invention relates to a sleep support system that establishes a proper "S-curve" shape of the human spine when the body is in the supine position.

BACKGROUND OF THE INVENTION

For individuals suffering lower back discomfort it is known that positioning the knees in flexion may provide relief from the discomfort. Such a position is known to reduce the stress placed on the lower back. By placing the knees in flexion, and with the body in a supine position, the spine forms what is considered to be a proper "S" curve that is the "natural" shape of the spine.

Attempts to relieve lower back pain through the use of appliances are known. For example, pillows have been placed behind the knees of a supine individual to place the knees in flexion. One prior art device includes straps attached to a pillow so that the pillow may be attached to the individual.

Another prior art device includes an inverted t-shaped pillow that is positioned between the legs of an individual. This device is designed to be securely fastened to the individual and to a bed upon which the individual adopts a supine position. The flanges of the t-shaped pillow include elevated sections such that the knees of the individual are firmly held in flexion. The trunk of the t-shaped pillow is designed to firmly hold the legs of the individual in a fixed relationship. Yet another inverted t-shaped prior art device is held in position by the action of the individual's legs firmly clamping down on the device. Yet a third inverted t-shaped prior art device includes protrusions on the trunk of the device such that when an individual is in the supine position, the legs of the individual are clamped between the protrusions and the flanges of the t-shaped device. In the latter two cases the legs of the individual are also held in a fixed position relative to each other.

Still another t-shaped device includes a body length trunk. This device is positioned so that the flanges of the t-shaped device are behind the individual's knees, thus placing the knees in flexion. The long trunk of the t-shaped device is worn up the front of the individuals body. This device may be secured in place by a strap worn around the chest of the individual. As with the previously described prior art devices, the legs of the wearer are held in a fixed position with respect to each other.

One prior art device approximates the shape of a wedge and includes channels into which the legs of a wearer are placed. In one orientation, this device maintains the legs of the wearer in flexion. Here too, the legs of the wearer are held in a fixed position with respect to each other.

Each of the above devices has also to some extent proven unreliable or cumbersome. One problem with the conventional appliances described above is that the legs of the wearer are held in a fixed position with respect to each other. Accordingly, a wearer of such devices would not be able to shift the relative position of the legs to provide even further relief from lower back stress. Such a shift in the position of the legs is, in one respect, a natural process that accompanies changing sleep positions. Therefore, a wearer of such devices would have to make an adjustment to the device, if such an adjustment is even possible, in order to accommodate changing sleep positions. Another problem with the prior art devices is that, in general the wearer's freedom of movement is greatly restricted. Such a restriction can add to the stresses placed on the lower back because the wearer of such devices will be constantly moving against the resistance the device creates. Still another problem with the prior art devices is that there is no provision for the positioning of just one leg in flexion. Yet an additional problem with the prior art devices is that there is no provision for varying the amount of flexion applied to the knees.

What would therefore be advantageous would be a sleep support system that allows for the natural shift in the relative position of a wear's legs that accompanies changing sleep positions. What would be a further advantage would be a sleep support system that affords general freedom of movement to accommodate changing sleep positions. Yet a further advantage would be a sleep support system that allows for the positioning of just one leg in flexion. Still a further advantage would be sleep support system that allows for the adjustment of the amount of flexion applied to a wearer's knee.

SUMMARY OF THE INVENTION

The present invention provides a sleep support system that allows for the natural shift in the relative position of a wear's legs that accompanies changing sleep positions. The present invention provides a sleep support system that affords general freedom of movement to accommodate changing sleep positions. The present invention also provides a sleep support system that allows for the positioning of just one leg in flexion. The present invention further provides a sleep support system that allows for the adjustment of the amount of flexion applied to a wearer's knee.

The present invention provides a sleep support system for establishing a proper S-curve shape of the human spine, the sleep support system including a first leg support, a first rest plane disposed on the first leg support, a second leg support operatively associated with the first leg support, and a second rest plane disposed on the second leg support. The first leg support and the second leg support define an L shape.

DETAILED DESCRIPTION OF THE INVENTION

Figure 1:
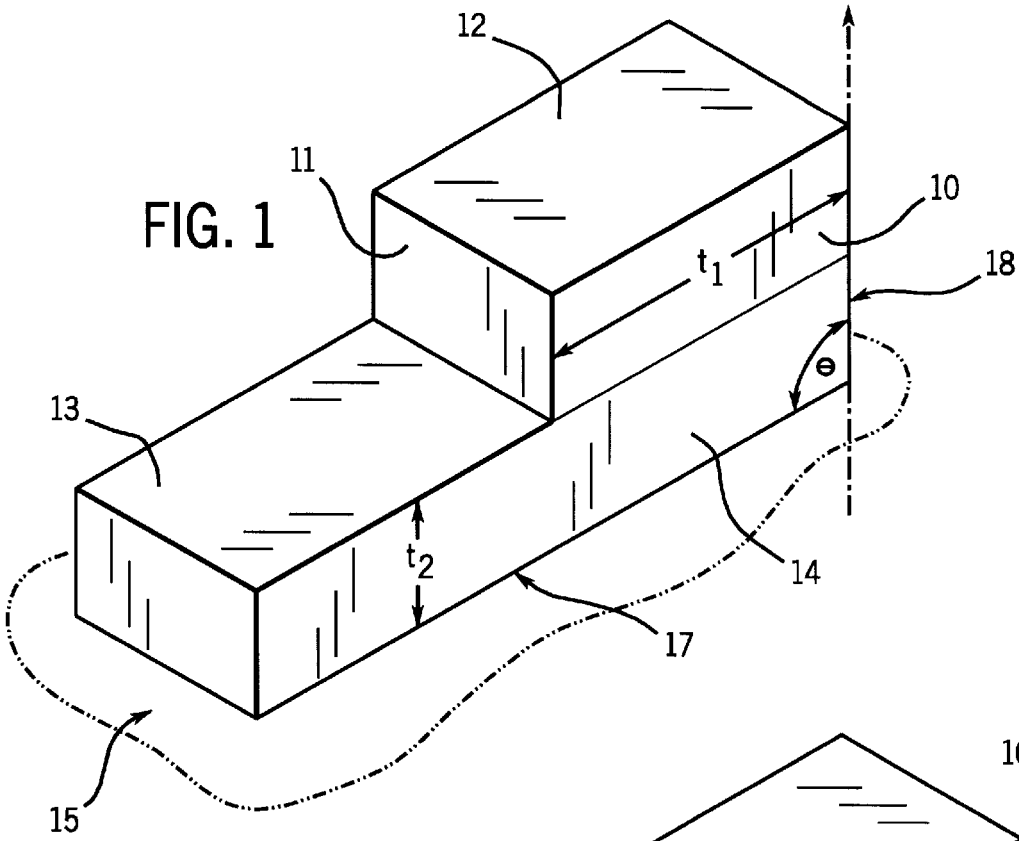
FIG. 1 is a schematic of a sleep support system made in a accordance with the principles of the present invention.

Referring to FIG. 1, a sleep support system made in accordance with the principles of the present invention is designated by 10. The sleep support system 10 includes a pillow-like device that includes a first rest plane 11, and second rest plane 13, such that the first rest plane 11 and the second rest plane 13 intersect. Associated with the first rest plane 11 is a thickness $t_1$ and associated with the second rest plane 13 is a thickness $t_2$, such that $t_1$ and $t_2$ are different. Generally, $t_1$ ranges from about 1.5 times $t_2$ to about 5 times $t_2$, and, preferably, $t_1$ ranges from about 2 to about 3 times $t_2$.

The sleep support system 10 further defines a long axis 17 and a short axis 18. The long axis 17 is approximately parallel to the second rest plane 13 and the short axis 18 is approximately parallel to the first rest plane 11. The short axis 18 thus defines the orientation of the first rest plane 11 and the long axis 17 thus defines the orientation of the second rest plane 13. As shown in FIG. 1, $t_1$ is the distance from the short axis 18 to the first rest plane 11 and $t_2$ is the distance from the long axis 17 to the second rest plane 13. The long axis 17 forms an internal angle Θ that, preferably, is nominally a right angle with the short axis 18, where the long axis 17 and the short axis 18 intersect. Thus, the sleep support system 10 is generally "L-shaped." However, the internal angle Θ may range from about 45° to about 135° . Preferably, the internal angle ranges from about 75° to about 105°.

The sleep support system 10 may also be described in terms of a first leg support 12 and a second leg support 14. Both the first leg support 12 and the second leg support 14 are preferably generally rectangular block-shaped. The first leg support 12 and the second leg support 14 may be integrally formed so that each element is part of the same piece, or the first leg support 12 and the second leg support 14 may be two separate pieces. In both cases, it is important that the relationship of the first leg support 12 to the second leg support 14 is such that the sleep support system 10 has a generally L-shaped configuration. Different shapes of the first leg support 12 and the second leg support 14 may be adapted to the sleep support system 10 such that the generally L-shaped configuration of the sleep support 10 is maintained. Thus, providing an L-shaped sleep support 10 system could also be accomplished if the first leg support 12 or the second leg support 14, or both, are ellipsoids. Accordingly, the shapes of the first leg support 12 and the second leg support 14 may include squares, rectangles, ovoids, cylinders, ellipsoids and combinations of these shapes.

Referring to FIG. 1, it can be seen that the first rest plane 11 is disposed on one surface of the first leg support 12. Similarly, the second rest plane 13 is disposed on one surface of the second leg support 14.

In use, the sleep support system 10 is positioned on a foundation 15 such as the surface of a bed or a floor. As will be described in further detail below, a person's leg is positioned on either the first rest plane 11 or the second rest plane 13 such that the knee of the person's leg is placed in flexion and the person's back is placed in a position that brings the person's spine into a natural "S" shaped curvature. Different amounts of flexion are achieved depending on which rest plane the leg is positioned. Thus, when the short axis 18 lies on the foundation 15 the thickness $t_1$ defines the amount of flexion the knee may be placed into. When the long axis 17 lies on the foundation 15 the thickness $t_2$ defines the amount of flexion the knee may be placed into.

The sleep support system 10, and, accordingly, the first leg support 12 and the second leg support 14, may be manufactured from materials found suitable for the manufacture of pillows and orthopedic cushions. Such materials include urethane foam, latex foam, natural fibers, synthetic fibers, feathers and down. Both the latex foam and the urethane foam may further include open-celled foam, closed-celled foam, or microcellular foam. The sleep support system 10 should be generally "L" shaped and should provide adequate firmness to support the weight of a person's leg. However, the sleep support system 10 should provide adequate comfort to the user and, therefore, the sleep support system 10 should not be so firm as to be hard to the touch.

Where the sleep support 10 is made from the latex foam or the urethane foam it is conventional describe the firmness of the foam in terms of the density of the foam. The art describes such foam, for example, as having a soft, medium or firm density. It is preferred, that where foam is used to make the sleep support system 10, that the foam have a density in the range of medium to firm, including medium and firm.

It is preferred that the sleep support system 10 be manufactured from a foam material that provides a continuous shape. Such foam material includes, for example, the latex foam and the urethane foam. The general L-shape of the sleep support system 10 may be cut from the firm foam material.

It is also preferred that the sleep support system 10 include a cover (not shown) that conforms to the shape of the sleep support system 10. The cover may be manufactured from materials found suitable for the manufacture of covers of pillows and orthopedic cushions. The cover material may include cotton, polyester, a cotton/polyester blend, denim, leather, suede, natural fur, and synthetic fur. The cover may be sewn in place to conform to the general L-shape of the sleep support system 10.

In an alternative embodiment , the cover may removable to facilitate cleaning of the cover, or changing the cover to change the appearance of the sleep support system 10. The removable cover includes means for fastening the removable cover to the sleep support system 10, such as a zipper, buttons, fasteners, and hook and loop fasteners.

The sleep support system 10 and the cover may also be manufactured to resist the growth of mold, bacteria, and the accumulation of allergens. Accordingly, the sleep support system 10 and the cover can be made anti-bacterial, non-allergenic, hypoallergenic, and mold resistant.

Where the sleep support system 10 is manufactured from a loose material, such as synthetic fibers, natural fibers, feathers, and down, a cover will provide the general L-shape of the sleep support system 10. In such cases, the sleep support system 10 may include an inner cover and an outer cover. The primary function of the inner cover is to conform the sleep support system 10 into a generally L-shape. Both the inner cover and the outer cover may be manufactured to be removable as described above. Additionally, both the inner cover and the outer cover may be manufactured from materials found suitable for the manufacture of covers of pillows and orthopedic cushions. The cover material may include cotton, polyester, a cotton/polyester blend, denim, leather, suede, natural fur, and synthetic fur. Alternately, either the inner cover, the outer cover, or both, may be sewn in place to conform to the general L-shape of the sleep support system 10.

Figure 2:
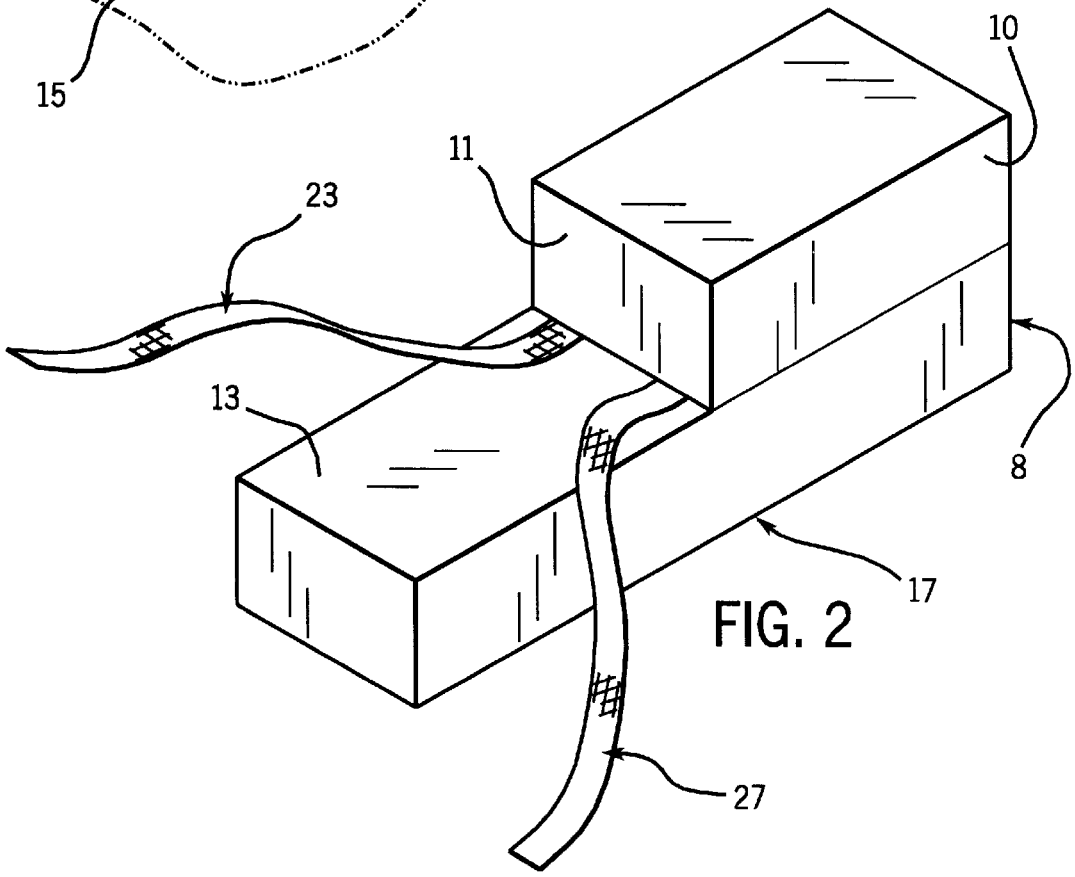
FIG. 2 is an alternative embodiment of the sleep support system of FIG. 1.

Referring to FIG. 2, an alternative embodiment of the sleep support system 10 is illustrated that includes attachment means. The sleep support system 10 includes a first strap 23 and a second strap 27. It is preferred that the first strap 23 and the second strap 27 are positioned at the intersection of the first rest plane 13 and the second rest plane 11. However, those skilled in the art will recognize that other positions may be used. The first strap 23 and the second strap 27 function to attach the sleep support system 10 to the leg of a person. Thus, the first strap 23 and the second strap 27 can be tied together around the leg of a person thereby attaching the sleep support 10 to the person's leg.

Figure 3:
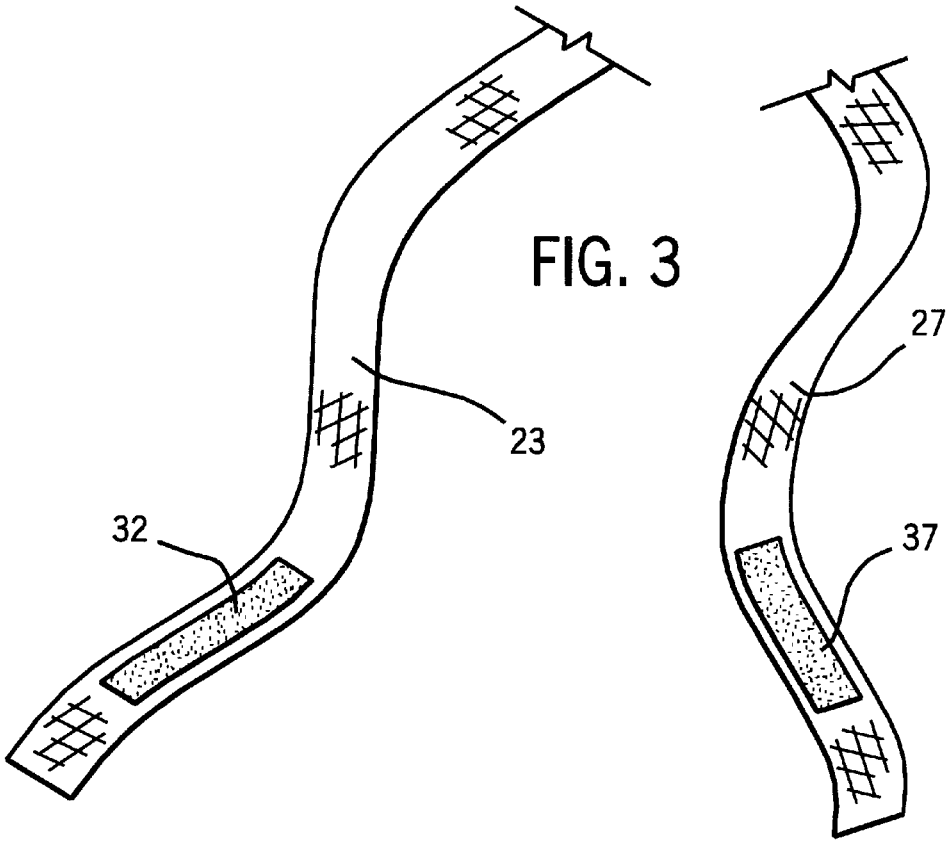
FIG. 3 is a schematic of an alternative embodiment of one of the components of the sleep support of FIG. 2.
Figure 4:
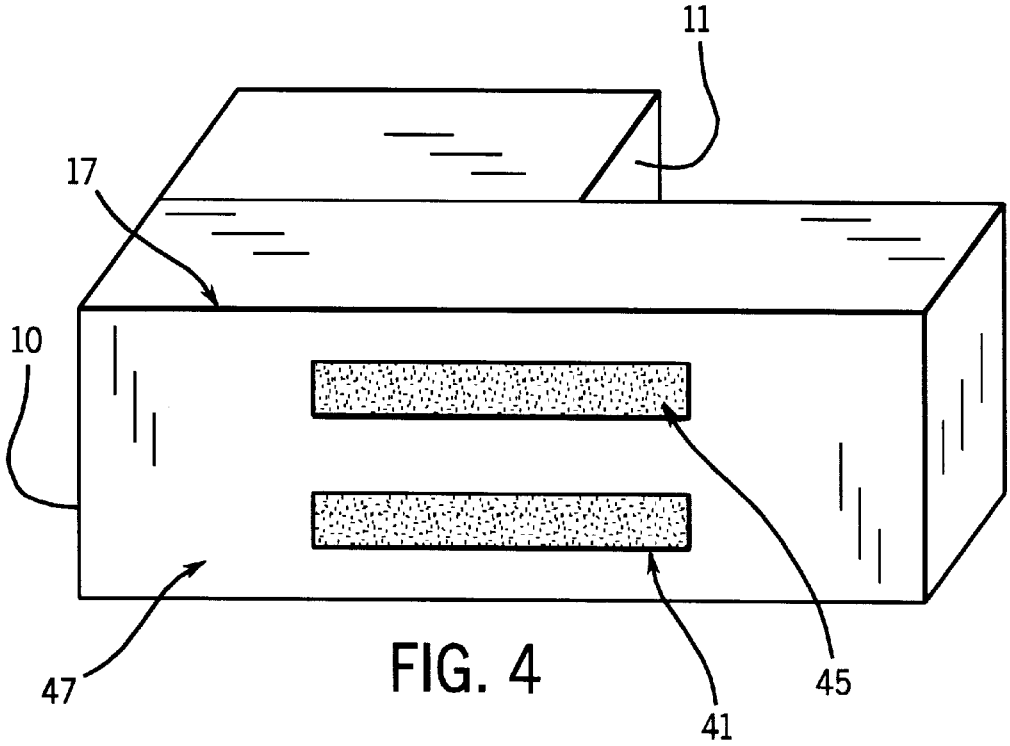
FIG. 4 is a schematic of an alternative embodiment of the sleep support system of FIG. 1.

Referring to FIGS. 3 and 4 the preferred attachment means is shown. First strap 23 includes a first hook and loop fastener 32. Similarly, the second strap 27 includes a second hook and loop fastener 37. The sleep support system 10 further defines a base 47. The long axis 17 is disposed on the long axis of the base 47. The base 47 further includes two hook and loop fasteners 41, 45, such that hook and loop fastener 41 is adapted to attach to the first hook and loop fastener 32 and hook and loop fastener 45 is adapted to attach to the second hook and loop fastener 37.

Figure 5:
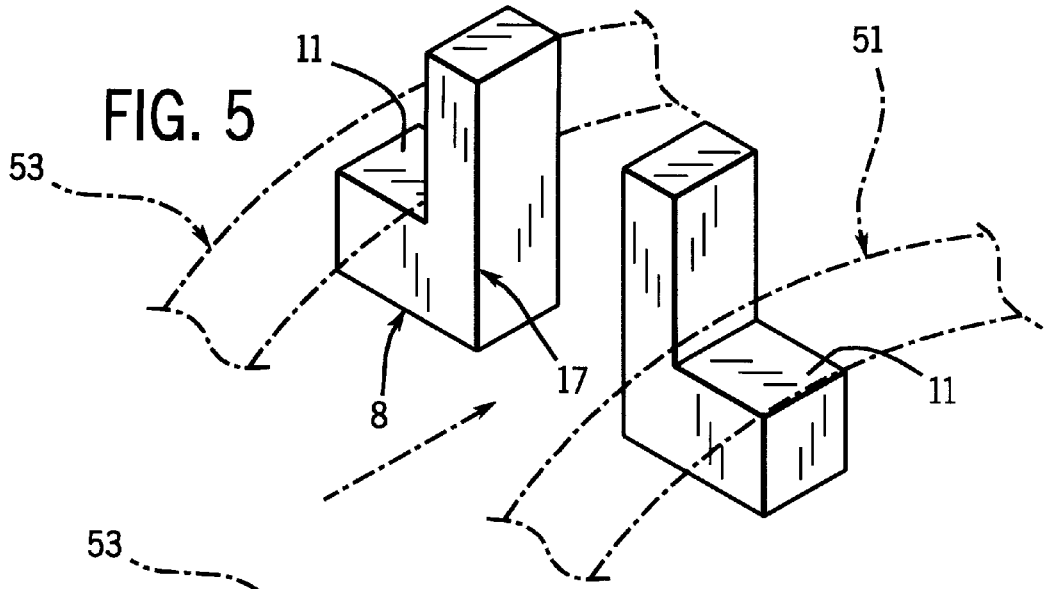
FIG. 5 is a schematic showing the use of one embodiment of the sleep support system of the present invention.
Figure 6:
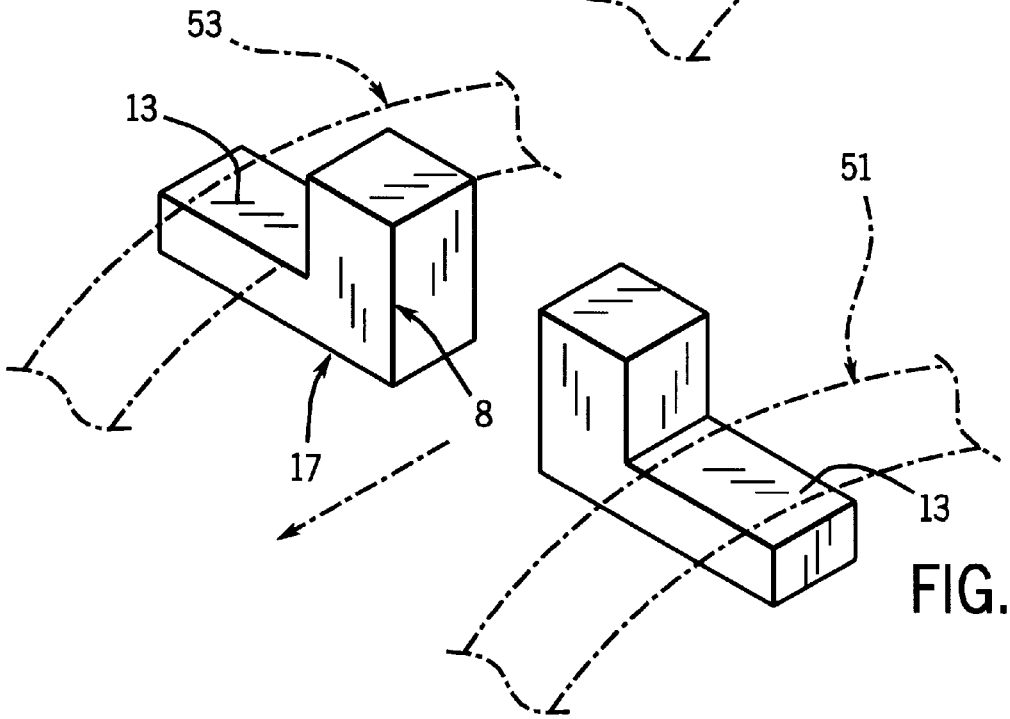
FIG. 6 is a schematic showing the use of one embodiment of the sleep support system of the present invention.

Referring to FIGS. 5 and 6, use of the sleep support system 10 is illustrated. In FIG. 5, a person's leg 51, 53 is positioned on the first rest plane 11 such that the short axis 8 lies on the foundation 15 and is perpendicular to the long axis of the leg 51, 53. A first strap 23 and a second strap 27 may be used to attach the sleep support 10 to the leg 51, 53. As shown in FIG. 5, the thickness $t_1$ controls the amount of flexion of the knee. Similarly, FIG. 6 illustrates a person's leg positioned on the second rest plane 13 such that the long axis 17 lies on the foundation 15. As shown in FIG. 6, the thickness $t_2$ controls the amount of flexion of the knee.

The sleep support system 10 also provides for separation of a person's legs further facilitating providing a proper posture for the person's back. One leg of the L-shaped sleep support system 10 provides such separation means. When a person's leg is positioned on the first rest plane 11, that portion of the sleep support system 10 defining the second rest plane 13 provides for separation of the person's legs. Likewise, when a person's leg is positioned on the second rest plane 13, that portion of the sleep support 10 defining the first rest plane 11 provides for separation of the person's legs.

The sleep support system 10 provides for flexion of the knees and separation of the legs either when the person wearing the sleep support system 10 is positioned in the supine position or lying on their side. Thus the sleep support system 10 provides freedom of movement to accommodate changing sleep positions.

Figure 7:
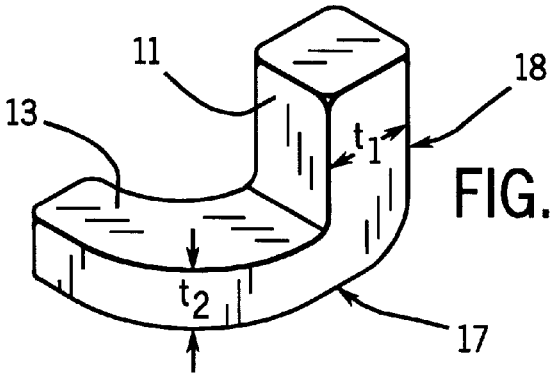
FIG. 7 is a schematic of an alternative embodiment of the sleep support system of the present invention.

Referring to FIG. 7 yet another alternative embodiment of the sleep support system 10 is shown. As described above, and further illustrated by FIG. 7, the sleep support system 10 may conform generally to an L-shape but the legs of the "L" need not be at right angles to one another. Additionally, the corners of the sleep support system 10 may be curved or rounded and it is not necessary to the utility of the sleep support 10 that the corners be right-angled corners.

There has been provided, in accordance with the present invention, a sleep support system that allows for the natural shift in the relative position of a wearer's legs that accompanies changing sleep positions. The present invention provides a sleep support system that affords general freedom of movement to accommodate changing sleep positions. The present invention provides a sleep support systems that accommodates placing just one leg in flexion. The present invention further provides a sleep support system that allows for an adjustment of the amount of flexion applied to a wearer's knee.

While the invention has been described with specific embodiments, many alternatives, modifications and variations will be apparent to those skilled in the art in light of the foregoing description. Accordingly, it is intended to include all such alternatives, modifications and variations set forth within the spirit and scope of the appended claims.

What is claimed is:

1. A sleep support system configured to support and position in flexion the knee region of one leg of a substantially supine individual comprising:

a length and a width;

a first leg support;

a first rest plane disposed in the first leg support, the first rest plane adapted to provide support for the leg during sleep;

a second leg support operatively associated with the first leg support; and a second rest plane disposed on the second leg support, the second rest plane adapted to provide support for the leg during sleep, the first rest plane and the second rest plane being oriented from about 75° to about 105° of each other;

such that the first leg support and the second leg support define a general L-shape for establishing a proper S-curve shape of the human spine and said length is disposed substantially perpendicular to the length of said leg when the system is in use.

2. The sleep support of claim 1 wherein the first leg support further defines a thickness $t_1$ and the second leg support further defines a thickness $t_2$, such that $t_1$ is greater than $t_2$.

3. The sleep support system of claim 2 wherein $t_1$ ranges from about 1.5 times $t_2$ to about 5 times $t_2$.

4. The sleep support system of claim 3 further wherein $t_1$ ranges from about 2 times $t_2$ to about 3 times $t_2$.

5. The sleep support system of claim 1 wherein the first leg support is made from a material selected from the group comprising urethane foam, latex foam, natural fibers, synthetic fibers, feathers, down, and combinations thereof.

6. The sleep support system of claim 5 wherein the latex foam is an open-celled foam.

7. The sleep support system of claim 1 wherein the second leg support is made from a material selected from the group comprising urethane foam, latex foam, natural fibers, synthetic fibers, feathers, down, and combinations thereof.

8. The sleep support system of claim 7 wherein the latex foam is an open-celled foam.

9. The sleep support system of claim 1 further including a cover.

10. The sleep support system of claim 9 wherein the cover is made from a material that is selected from the group comprising cotton, polyester, a cotton/polyester blend, denim, leather, suede, natural fur, synthetic fur, and combinations thereof.

11. A sleep support system comprising:

a first leg support;

a first rest plane disposed in the first leg support, the first rest plane adapted to provide support for the leg during sleep;

a second leg support operatively associated with the first leg support; and a second rest plane disposed on the second leg support, the second rest plane adapted to provide support for the leg during sleep;

a first strap and a second strap for attaching the sleep support system to a wearer, the first strap and the second strap positioned at the intersection of the first rest plane and the second rest plane;

such that the first leg support and the second leg support define a general L-shape for establishing a proper S-curve shape of the human spine.

12. The sleep support system of claim 1 further including means for attaching the sleep support system to a wearer.

13. The sleep support system of claim 12 wherein the attachment means includes a first strap a second strap.

14. A sleep support system comprising:

a first leg support;

a first rest plane disposed in the first leg support, the first rest plane adapted to provide support for the leg during sleep;

a second leg support operatively associated with the first leg support; and a second rest plane disposed on the second leg support, the second rest plane adapted to provide support for the leg during sleep;

a first strap and a second strap positioned at the intersection of the first rest plane and the second rest plane;

such that the first leg support and the second leg support define a general L-shape for establishing a proper S-curve shape of the human spine.

15. The sleep support system of claim 13 wherein the first strap includes a first hook and loop fastener.

16. The sleep support system of claim 13 wherein the second strap includes a second hook and loop fastener.

17. A sleep support system configured to support and position in flexion the knee region of one leg of a substantially supine individual comprising:

a length and a width;

a first rest plane adapted to provide support for the leg during sleep;

a second rest plane support operatively associated with the first rest plane, the second rest plane adapted to provide support for the leg during sleep;

a short axis defining the orientation of the first rest plane;

a long axis defining the orientation of the second rest plane, the long axis intersecting the short axis; and an internal angle defined by the intersection of the long axis and the short axis, the internal angle being from about 75° to about 105°;

such that the first rest plane and the second rest plane define a general L-shape for establishing a proper S-curve shape of the human spine and said length is disposed substantially perpendicular to the length of said leg when the system is in use.

18. The sleep support system of claim 17 wherein the sleep support system is made from a material selected from the group comprising urethane foam, latex foam, natural fibers, synthetic fibers, feathers, down, and combinations thereof.

19. The sleep support system of claim 18 wherein the latex foam is an open cell foam.

20. The sleep support system of claim 2 further including a cover.

21. The sleep support system of claim 20 wherein the cover is made from a material that is selected from the group comprising cotton, polyester, a cotton/polyester blend, denim, leather, suede, natural fur, synthetic fur, and combinations thereof.

22. A sleep support system configured to support and position in flexion the knee region of one leg of a substantially supine individual comprising:

a length and a width;

a first rest plane adapted to provide support for the leg during sleep;

a second rest plane support operatively associated with the first rest plane, the second rest plane adapted to provide support for the leg during sleep;

an inner cover and an outer cover;

a short axis defining the orientation of the first rest plane;

a long axis defining the orientation of the second rest plane, the long axis intersecting the short axis; and an internal angle defined by the intersection of the long axis and the short axis, the internal angle being from about 75° to about 105°;

such that the first rest plane and the second rest plane define a general L-shape for establishing a proper S-curve shape of the human spine and said length is disposed substantially perpendicular to the length of said leg when the system is in use.

23. The sleep support system of claim 17 further including means for attaching the sleep support system to a wearer.

24. The sleep support system of claim 23 wherein the attachment means includes a first strap a second strap.

25. A sleep support system comprising:

a first rest plane adapted to provide support for the leg during sleep;

a second rest plane support operatively associated with the first rest plane, the second rest plane adapted to provide support for the leg during sleep;

a first strap and a second strap positioned at the intersection of the first rest plane and the second rest plane;

a short axis defining the orientation of the first rest plane;

a long axis defining the orientation of the second rest plane, the long axis intersecting the short axis; and an internal angle defined by the intersection of the long axis and the short axis;

such that the first rest plane and the second rest plane define a general L-shape for establishing a proper S-curve shape of the human spine.

26. The sleep support system of claim 24 wherein the first strap includes a first hook and loop fastener.

27. The sleep support system of claim 24 wherein the second strap includes a second hook and loop fastener.

28. A method for establishing a proper S-curve shape of a person's spine during sleep, the method comprising:

providing a foundation;

positioning the person in a supine position on the foundation;

provide support for a knee during sleep in a first rest plane;

provide support for said knee during sleep in a second rest plane;

the first rest plane and the second rest plane defining a general L-shape for establishing a proper S-curve shape of the human spine, the first rest plane and the second rest plane being oriented from about 75° to about 105° of each other; and attaching to said knee a sleep support system defining the first rest plane and the second rest plane and having a length and a width;

such that said knee of a leg is held in flexion and said length is perpendicular to the length of said leg during sleep.

29. The method of claim 28 wherein the person's leg is positioned on the first rest plane.

30. The method of claim 29 further providing means for separation of the person's legs, the separating means including the second rest plane.

31. The method of claim 28 wherein the person's leg is positioned on the second rest plane.

32. The method of claim 31 further providing means for separation of the person's legs, the separating means including the first rest plane.

* * * * *